US008159419B2

(12) United States Patent
Lee et al.

(10) Patent No.: US 8,159,419 B2
(45) Date of Patent: Apr. 17, 2012

(54) DISPLAY APPARATUS AND CONTROL METHOD THEREOF

(75) Inventors: Sang-hoon Lee, Ulsan (KR); Jeong-il Kang, Yongin-si (KR); Kyoung-geun Lee, Suwon-si (KR); Yung-jun Park, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 720 days.

(21) Appl. No.: 11/433,573

(22) Filed: May 15, 2006

(65) Prior Publication Data

US 2007/0001943 A1 Jan. 4, 2007

(30) Foreign Application Priority Data

Jul. 1, 2005 (KR) ..... 10-2005-0059379

(51) Int. Cl.
*G09G 3/30* (2006.01)

(52) U.S. Cl. ..... 345/76; 345/82; 345/83; 345/204; 345/102; 345/211; 315/169.3; 313/463

(58) Field of Classification Search ..... 345/76–83, 345/690–693, 88, 102, 204, 211; 362/611, 362/612; 315/169.3; 313/463
See application file for complete search history.

(56) References Cited

U.S. PATENT DOCUMENTS

| | | | | |
|---|---|---|---|---|
| 4,321,598 | A * | 3/1982 | Warner | 345/82 |
| 6,124,853 | A * | 9/2000 | Palalau et al. | 345/212 |
| 6,867,757 | B1 | 3/2005 | Nakamura | |
| 7,088,321 | B1 | 8/2006 | Parker | |
| 7,391,335 | B2 * | 6/2008 | Mubaslat et al. | 340/657 |
| 2003/0001807 | A1 * | 1/2003 | Debiez et al. | 345/82 |
| 2003/0217972 | A1 * | 11/2003 | Connell et al. | 210/646 |
| 2004/0208011 | A1 * | 10/2004 | Horiuchi et al. | 362/458 |
| 2005/0242034 | A1 * | 11/2005 | Connell et al. | 210/646 |
| 2006/0028156 | A1 * | 2/2006 | Jungwirth | 315/312 |

FOREIGN PATENT DOCUMENTS

| | | |
|---|---|---|
| JP | 57-34590 | 2/1982 |
| JP | 06-214519 | 8/1994 |
| JP | 08-137442 | 5/1996 |
| JP | 2000-200069 | 7/2000 |
| JP | 2000-214825 | 8/2000 |
| JP | 2002-056997 | 2/2002 |
| JP | 2004-533111 | 10/2004 |
| KR | 100230187 | 8/1999 |
| KR | 1020040077211 A | 9/2004 |
| WO | WO 03/038794 | 5/2003 |

* cited by examiner

*Primary Examiner* — Lun-Yi Lao
*Assistant Examiner* — Insa Sadio
(74) *Attorney, Agent, or Firm* — Roylance, Abrams, Berdo & Goodman, L.L.P.

(57) ABSTRACT

A display apparatus is provided to operate a light emitting unit with a small number of power drivers. The display apparatus has a plurality of light emitting units, a power driver, whose total provided therein is less than the total of light emitting units, that outputs driving power to the light emitting units. A power switch is switched on and off to supply the driving power to one of the plurality of light emitting units, and a controller controls the power switch to sequentially supply the driving power to the plurality of light emitting units.

11 Claims, 4 Drawing Sheets

DISPLAY APPARATUS AND CONTROL METHOD THEREOF

CROSS-REFERENCE TO RELATED APPLICATIONS

This application claims the benefit under 35 U.S.C. §119 (a) of Korean Patent Application No. 2005-0059379, filed on Jul. 1, 2005, in the Korean Intellectual Property Office, the entire disclosure of which is hereby incorporated by reference.

BACKGROUND OF THE INVENTION

1. Field of the Invention

The present invention relates to a display apparatus and a control method thereof. More particularly, the present invention relates to a display apparatus having an improved power driver to supply power to a light emitting unit and a control method thereof.

2. Description of the Related Art

Generally, display apparatuses employ a cathode ray tube (CRT) and a flat panel display (FPD). The FPD displays an image thereon and typically comprises a liquid crystal display (LCD) panel or a plasma display panel (PDP). Also, new kinds of display apparatuses are being developed such as organic light emitting diodes (OLED), and digital lighting processing (DLP).

The display apparatus, such as the LCD and the DLP, utilizes light emitting elements like a light emitting diode (LED) as an additional light source, which provides excellent color realization.

A conventional display apparatus is provided with an additional power supply in every predetermined LED unit. Thus, the conventional display apparatus comprises a large number of power drivers, thereby providing a complex structure and raising costs.

Accordingly, there is a need for an improved display apparatus with a simple structure having a less number of power drivers provided therein, to supply power to light emitting units.

SUMMARY OF THE INVENTION

An aspect of embodiments of the present invention is to address at least the above problems and/or disadvantages and to provide at least the advantages described below. Accordingly, an aspect of embodiments of the present invention is to provide a display apparatus and control method thereof which operates a light emitting unit with a small number of power drivers.

Additional aspects and/or advantages of exemplary embodiments of the present invention will be set forth in part in the description which follows and, in part, will be obvious from the description, or may be learned by practice of the present invention.

The foregoing and/or other aspects of exemplary embodiments of the present invention are also achieved by providing a display apparatus comprising a plurality of light emitting units. Power drivers are provided for outputting driving power to the plurality of light emitting units, wherein a total number of the power drivers provided therein is less than a total number of light emitting units. A power switch switches on and off in order to supply the driving power to one of the plurality of light emitting units. A controller controls the power switch to sequentially supply the driving power to the plurality of light emitting units.

According to another aspect of exemplary embodiments of the present invention, the power driver includes a plurality of power drivers, and the controller controls respective power drivers to sequentially output driving power corresponding to a respective plurality of light emitting units.

According to yet another aspect of exemplary embodiments of the present invention, the controller controls the power switch to supply the driving power generated by one of the power drivers to one of the plurality of light emitting units, and generates the driving power by another one of the power drivers to be supplied to one of the light emitting units which emits light next.

According to an aspect of embodiments of the present invention, the controller supplies a predetermined reference voltage to the power drivers, and the power drivers compare an output voltage proportional to a current supplied to the plurality of light emitting units to the reference voltage, in order to output the driving power.

According to still another aspect of exemplary embodiments of the present invention, the power drivers comprise a pulse width modulation (PWM) generator for generating a PWM signal according to a comparison result, by comparing the output voltage and the reference voltage; and a PWM switch to switch on and off power supply according to the PWM signal.

According to another aspect of exemplary embodiments the present invention, the power switch comprises switching elements, which are respectively provided in the plurality of light emitting units, and controlled by the controller, in order to selectively switch on and off the driving power output from the power drivers, and sequentially supply the driving power to the plurality of light emitting units.

The foregoing and/or other aspects of exemplary embodiments of the present invention are also achieved by providing a method of controlling a display apparatus having a plurality of light emitting units, comprising providing power drivers to output driving power to the plurality of light emitting units; generating driving power to be supplied to the plurality of light emitting units; supplying the driving power to one of the plurality of light emitting units; and supplying the driving power sequentially to a respective plurality of light emitting units.

According to another aspect of exemplary embodiments of the present invention, the method further comprises controlling respective power drivers to sequentially output driving power corresponding to the respective plurality of light emitting units.

According to yet another aspect of exemplary embodiments of the present invention, the method further comprises supplying the output driving power from one of the power drivers to one of the plurality of light emitting units, and generating driving power by another one of the power drivers to be supplied to one of the plurality of light emitting units which emits light next.

According to still another aspect of exemplary embodiments of the present invention, the driving power is generated by comparing an output voltage that is proportional to current supplied to the plurality of light emitting units and a predetermined reference voltage.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
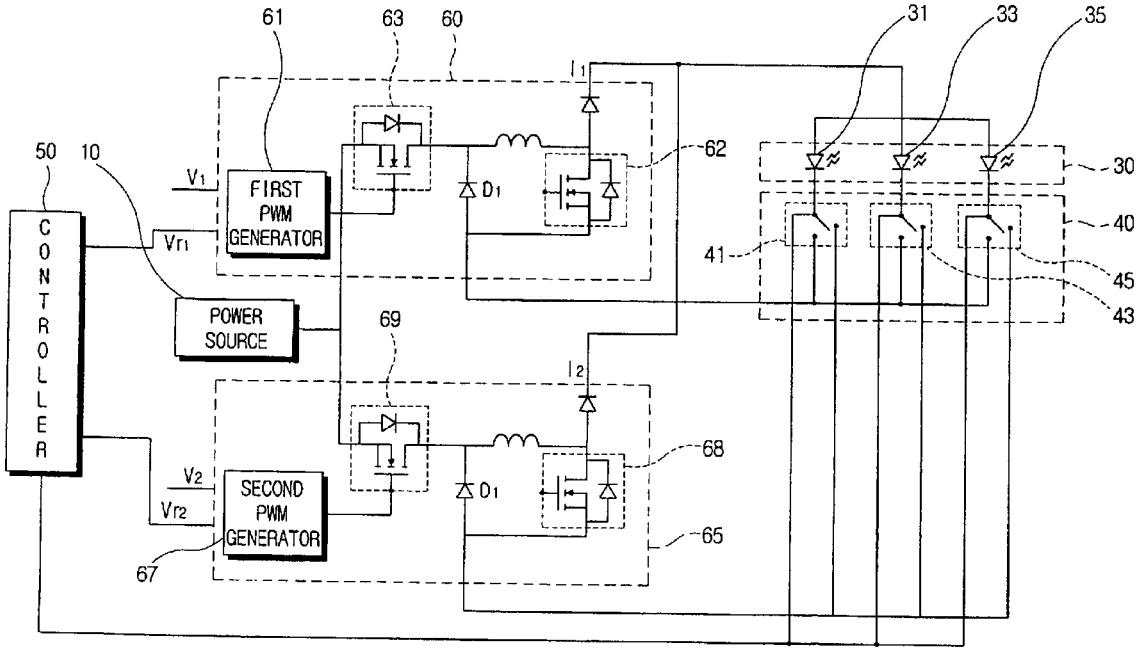
FIG. 1 is a control block diagram of a display apparatus according to a first exemplary embodiment of the present invention.

As shown in FIG. 1, a display apparatus according to exemplary embodiments of the present invention comprises a plurality of light emitting units 30, a power source 10, a first power driver 60 and a second power driver 65, a power switch 40 for switching on and off power supplied to the light emitting units 30, and a controller 50 for controlling the foregoing elements.

The plurality of light emitting units 30 preferably comprises light emitting diodes (LEDs). Accordingly, the LEDs preferably comprise a RLED 31 to emit a red light; GLED 33 to emit a green light; and BLED 35 to emit a blue light. The plurality of light emitting units 30 may further comprise a CLED to emit a cyan light, YLED to emit a yellow light and WLED to emit a white light.

Hereinafter, the plurality of light emitting units 30 comprising the RLED 31, GLED 33 and BLED 35 will be described by way of example.

The respective light emitting units 30 of the display apparatus according to the present invention emit light sequentially.

For example, if the display apparatus is provided as a projection TV employing a digital lighting processing (DLP), the apparatus comprises a plurality of light emitting units 30 including the RLED 31, GLED 33 and BLED 35 as a light source. The respective light emitting units 30 sequentially emit light as follow: the RLED 31 emits light first; then the GLED 33 emits light at a predetermined time after the RLED 31 stops emitting light; and finally the BLED 35 emits light at a predetermined time after the GLED 33 stops emitting light.

The power drivers 60 and 65 control power supplied by the power source 10 and supply driving power to an electrode of the LEDs in the plurality of light emitting units 30. At this time, luminance of the LEDs in the plurality of light emitting units 30 is controlled by the amount of current supplied by the power drivers 60 and 65.

The power drivers 60 and 65 compare output reference voltages Vr1 and Vr2 from the controller 50 (to be described later), to output voltages V1 and V2 that is proportional to current supplied to the plurality of light emitting units 30. The comparison result controls the amount of current supplied to the LEDs.

The power drivers 60 and 65 preferably comprise pulse width modulation (PWM) generators 61 and 67 for generating a PWM signal according to the comparison result. The power drivers 60 and 65 also preferably comprise PWM switches 63 and 69 for switching on and off power according to the PWM signal in order to output driving power.

The PWM generators 61 and 67 comprise a comparator to compare the output voltages V1 and V2 to the reference voltages Vr1 and Vr2. If a value of the output voltages V1 and V2 is larger than that of the reference voltages Vr1 and Vr2, the PWM generators 61 and 67 output "1". If the value of the output voltages V1 and V2 is smaller than that of the reference voltages Vr1 and Vr2, the PWM generators 61 and 67 output "0".

The amount of current supplied to the LEDs in the plurality of light emitting units 30 is adjusted by switching on and off the PWM switches 63 and 69 so the amount of current increases and decreases repeatedly. The luminance of the plurality of light emitting units 30 is determined by an average value of the current.

In exemplary embodiments of the present invention, the PWM switches 63 and 69 are preferably metal-oxide semiconductor field effect transistor (MOSFET), but not limited thereto. Alternatively, various PWM switches may be provided as long as they switch on and off power.

The power switch 40 allows the driving power to be supplied to one of the plurality of light emitting units 30. The power switch 40, according to a first exemplary embodiment of the present invention, preferably comprise switching elements 41, 43 and 45, which are respectively provided in the plurality of light emitting units 30. Alternatively, various power switches may be provided as long as it sequentially supplies an output of a power supply to the respective light emitting units 30.

The controller 50 controls the power switch 40 to sequentially supply the driving power to the plurality of LEDs in the plurality of light emitting units 30, which sequentially emit light.

The controller 50 also controls the power drivers 60 and 65 to sequentially output driving power corresponding to the respective light emitting units 30. Particularly, the controller controls the switching elements to selectively control the driving power output from the plurality of power drivers 60 and 65 to be supplied sequentially to the plurality of light emitting units 30.

Specifically, the display apparatus comprises a plurality of light emitting units 30, each with three LEDs, such as RLED 31, GLED 33 and BLED 35, and two power drivers 60 and 65. An operation of the controller 50 will be described as an example of the present invention.

The controller 50 supplies a predetermined reference voltage Vr1 to a first power driver 60 and controls the first power driver 60 to generate driving power 11 to be supplied to the RLED 31, thereby allowing the RLED 31 to emit light. The controller 50 controls the switching element connected with the RLED 31 to supply the driving power 11 generated by the first power driver 60 to the RLED 31. If the GLED 33 emits light following the RLED 31, the controller 50 supplies a predetermined reference voltage Vr2 to the second power driver 65, and controls the second driving power 65 to generate driving power 12 to drive the GLED 33. At this time, the switching elements, except the switching elements connected with the RLED 31, are turned off and the driving power generated by the second power driver 65 is no longer supplied to the GLED 33.

As shown in FIG. 1, power drivers 60 and 65, according to a second exemplary embodiment of the present invention, preferably comprise transistors 62 and 68. Here, the transistors 62 and 68 may operate as a power switch 40 instead of switches 41, 43 and 45.

Specifically, if the transistors 62 and 68 are turned off, the driving power output from pulse width modulation (PWM) generators 61 and 67 is supplied to the plurality of light emitting units 30 through the PWM switches 63 and 69. If the transistors 62 and 68 are turned on, the driving power is supplied to a closed circuit that comprises the transistors 62 and 68, a diode D1 and an inductor, instead of being supplied to the plurality of light emitting units 30.

If the transistors 62 and 68 operate as the power switch 40, according to the second exemplary embodiment of the present invention, the controller 50 controls the transistors 62 and 68 to turn the transistors 62 and 68 on and off. The controller 50 further controls power supplied by the first power driver 60 and the second power driver 65 to sequentially supply driving power to the LEDs such as RLED 31, GLED 33 and BLED 35.

In addition, the display apparatus preferably comprise a circuit to block the driving power generated from the power drivers 60 and 65 from being supplied to the plurality of light emitting units 30 by providing a switch in an output terminal of the power drivers 60 and 65.

Even though the same current is supplied to the LEDs of the plurality of light emitting units 30, the luminance of the respective LEDs recognized by a user is various due to the characteristic of colors. Thus, the controller 50 variously supplies reference voltages Vr1 and Vr2 to the power drivers 60 and 65, according to the luminance of a screen.

Figure 2:
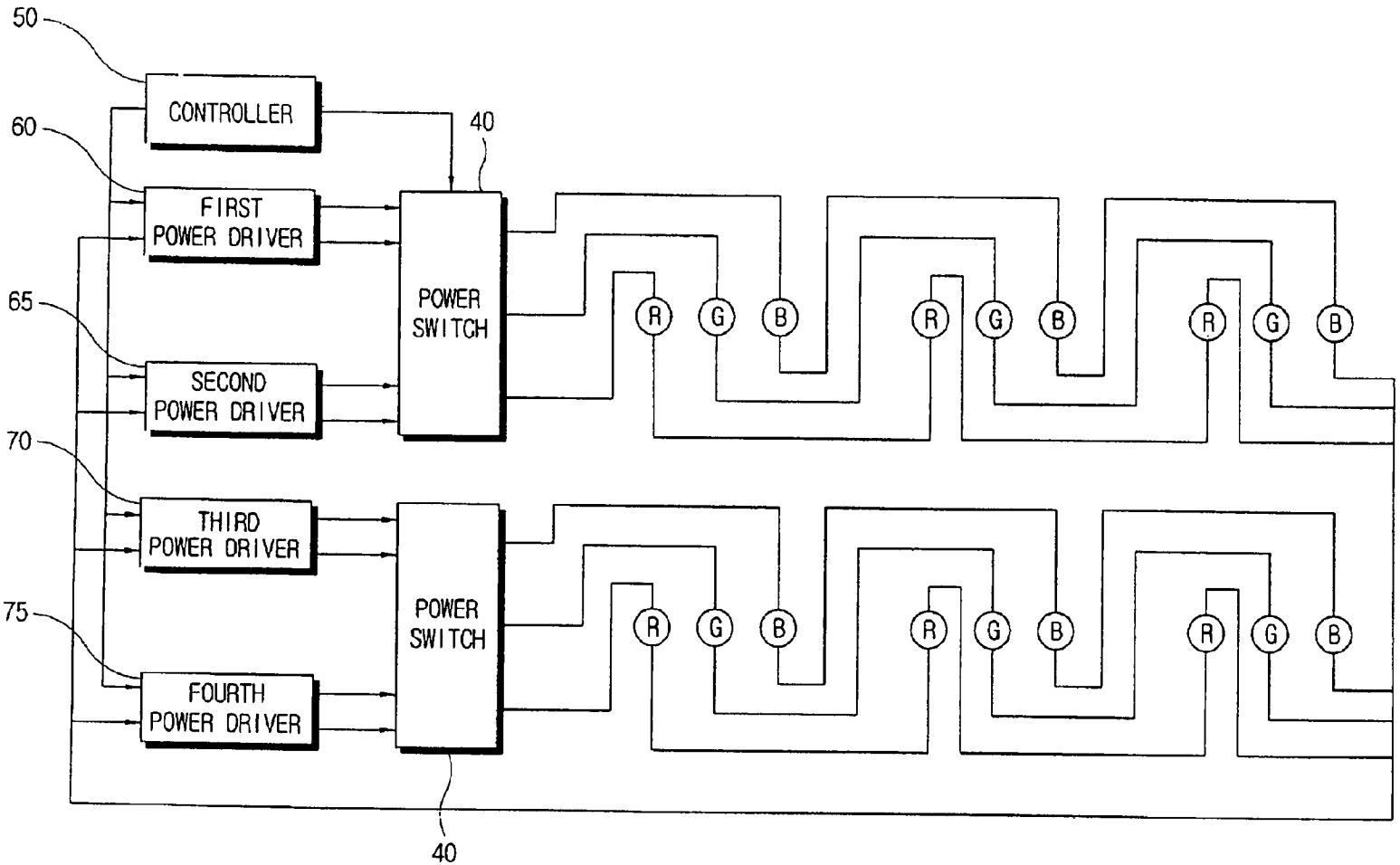
FIG. 2 is a control block diagram of a display apparatus according to a second exemplary embodiment of the present invention.

FIG. 2 illustrates a display panel having the plurality of light emitting units 30 by way of example.

Specifically, FIG. 2 illustrates six light emitting units 30. Each of the light emitting units 30 comprises a RLED unit, GLED unit, and BLED unit. Three of the light emitting units 30 receive driving power either from the first power driver 60 or from the second power driver 65. The other three light emitting units 30 receive the driving power either from a third power driver 70 or from a fourth power driver 75.

Preferably, the display apparatus in FIG. 2 comprises a liquid crystal display (LCD) panel. Alternatively, the display apparatus may vary as long as the LCD is disposed in the display apparatus as a structure shown in FIG. 2.

As described above, the controller 50 drives the first power driver 60 to generate the driving power supplied to the RLED unit. The controller 50 controls the power switch 40 to output the driving power generated by the first power driver 60, to the RLED unit. While the driving power generated by the first power driver 60 is outputted to the RLED unit, the controller 50 controls the second power driver 65 to generate driving power to be supplied to the GLED unit which emits light following the RLED unit. As a result, the controller 50 cuts off the driving power supplied to the RLED unit after predetermined periods of time, and controls the power switch 40 to supply the driving power generated by the second power driver 65 to the GLED unit. The controller 50 then controls the first power driver 60 to generate driving power to be supplied to the BLED unit.

A third power driver 70 and a fourth power driver 75 are driven in the same manner as the first power driver 60 and the second power driver 65.

Figure 3:
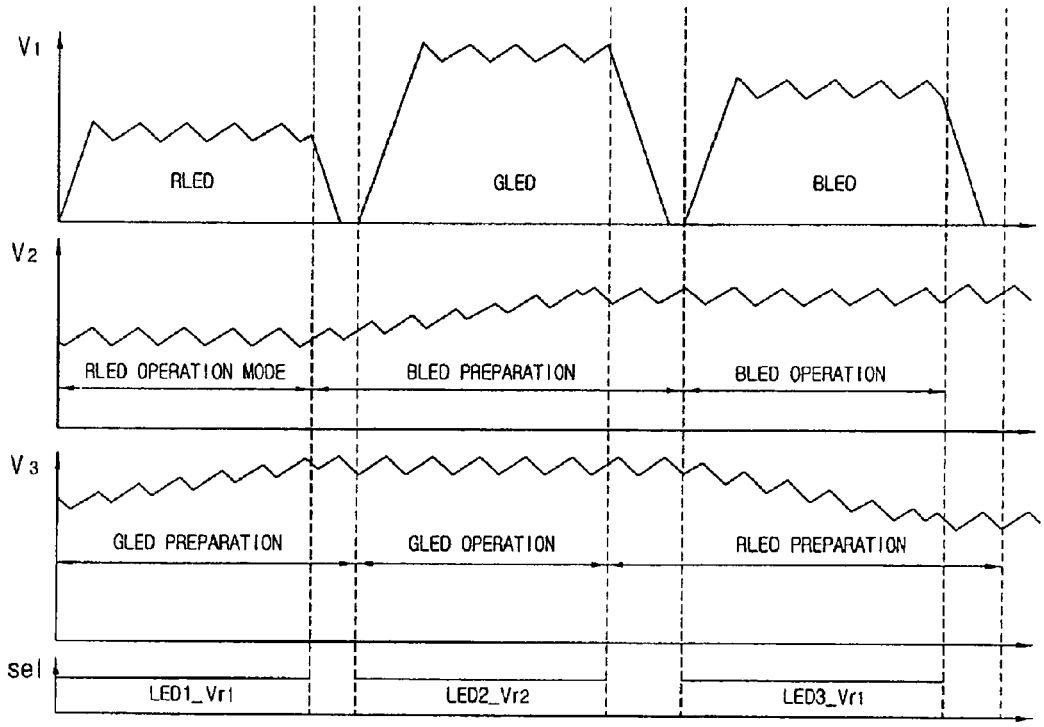
FIG. 3 illustrates the state of a light emitting unit, a power driver and a switch according to an exemplary embodiment of the present invention.

As shown in FIG. 3, if two power drivers 60 and 65 are provided in the display apparatus, according to the exemplary embodiments of the present invention, the controller 50 controls the power switch 40 to select the RLED 31. The first power driver 60, operating in an operation mode, thereby allows the RLED 31 to emit light. Also, the controller 50 supplies the predetermined reference voltage Vr2 to the second power driver 65, operating in a preparation mode, to generate driving power supplied to the GLED 33. The controller 50 preferably controls the respective LEDs in the light emitting units 30 to emit light by repeating the foregoing operations.

With the circuit comprising the inductor, as shown in FIG. 1, response time of the current to the light emitting units 30 is long and takes predetermined periods of time to generate a proper voltage when a comparison current is supplied.

Figure 4:
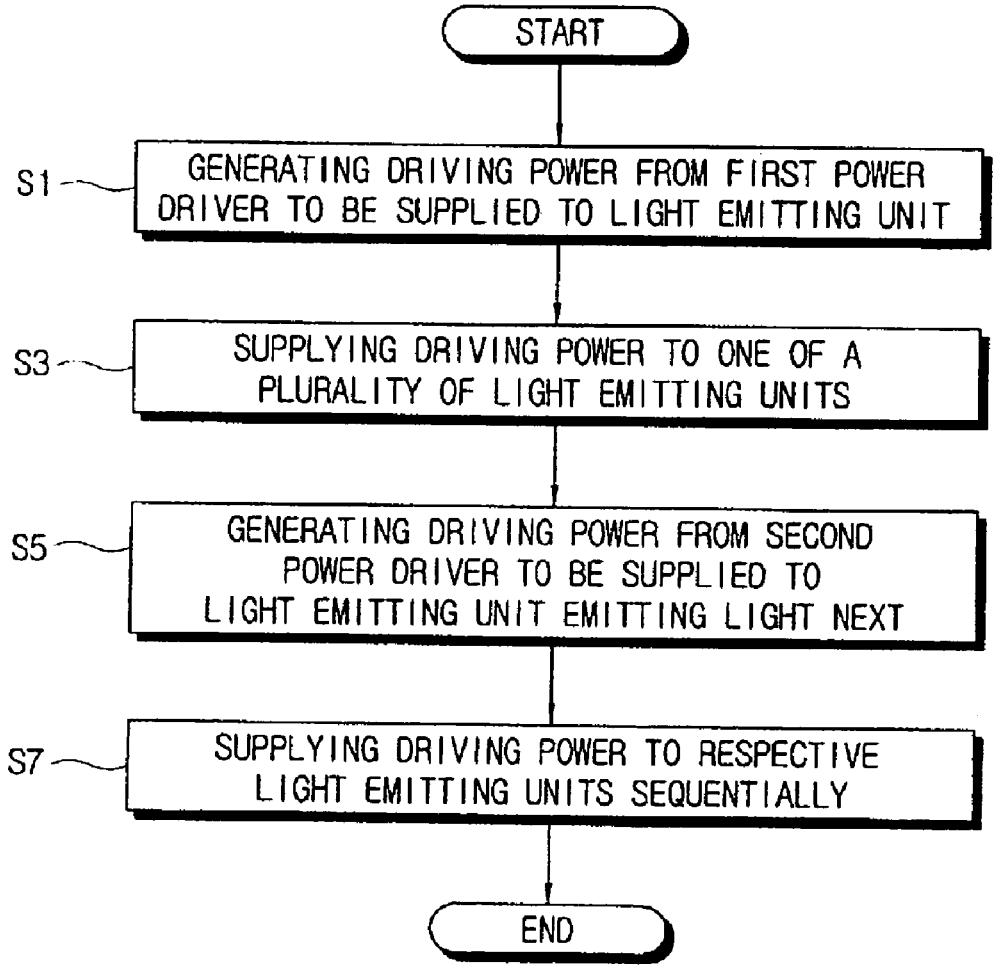
FIG. 4 is a control flowchart of the display apparatus according to an exemplary embodiment of the present invention.

As shown in FIG. 4, in the display apparatus according to the exemplary embodiments of the present invention, the first power driver 60 generates driving power to be supplied to one RLED 31 of the light emitting units 30 at operation S1. The controller 50 controls the power switch 40 to supply the driving power generated by the first power driver 60 to the RLED 31 at operation S3. Then, the controller 50 controls the second power driver 65 to generate driving power to be supplied to the GLED 33 emitting light following the RLED 31, at operation S5. At this time, the controller 50 supplies the predetermined reference voltages Vr1 and Vr2 to the respective power drivers 60 and 65 to generate driving power to be supplied to the plurality light emitting units 30. Thus, the power drivers 60 and 65 compare the reference voltages Vr1 and Vr2 to the output voltages V1 and V2. The output voltages V1 and V2 correspond to the amount of current supplied to the plurality of light emitting units 30 in order to generate the driving power.

While one of the power drivers 60 and 65 outputs driving power to be supplied to one of the plurality of light emitting units 30, the other one of the power drivers 60 and 65 generate driving power to be supplied to another one of the plurality of light emitting units 30. The respective light emitting units 30 preferably receive the driving power sequentially by repeating the foregoing operations, at operation S7.

In the foregoing exemplary embodiments of the present invention, the output voltages V1 and V2 are preferably detected by the voltage of the current flowing in a detection resistor. Alternatively, the output voltages V1 and V2 are preferably detected in various methods as long as the detected voltage corresponds to the current supplied to the plurality of light emitting units 30.

In the foregoing exemplary embodiments of the present invention, FIG. 1 illustrates the power switch 40 and the transistors 62 and 68 as a switching part to be switched on and off. Alternatively, either the power switch 40 or the transistors 62 and 68 may be provided as the switching part. The power switch 40 and the transistors 62 and 68 are named differently, but perform the same function.

In the foregoing exemplary embodiment of the present invention, transistors 62 and 68 are provided as the switching part. Alternatively, various transistors may be provided as long as they are switched on and off.

As described above, the display apparatus, according to the exemplary embodiments of the present invention comprises the power drivers 60 and 65, regardless of the number of light emitting units 30 provided therein. The display apparatus according to the exemplary embodiments of the present invention comprises less number of the power drivers, thereby reducing internal elements and production costs.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A display apparatus comprising a plurality of light emitting units, comprising:

a plurality of power drivers, comprising a first power driver and a second power driver, for outputting driving power to the plurality of light emitting units, wherein a total of the power drivers provided therein is less than a total of light emitting units;

a power switch controllable to selectively supply the driving power from at least one of the first and second power drivers to at least one of the plurality of light emitting units; and a controller for controlling the power switch to sequentially supply the driving power from the first and second power drivers to the at least one of the plurality of light emitting units;

wherein the controller supplies a first reference voltage and a second reference voltage to the first and second power drivers, respectively, the first power driver outputs driving power to be supplied to a first light emitting unit, the second power driver outputs driving power to be supplied to a second light emitting unit, and the plurality of light emitting units comprise the first and the second light emitting units.

2. The display apparatus according to claim 1, wherein each light emitting unit comprises a plurality of light emitting elements, and the controller controls the first and second power drivers to sequentially output driving power to the respective first light emitting unit and the second light emitting unit.

3. The display apparatus according to claim 1, wherein the controller controls the power switch to supply the driving power generated by the first power driver to the first light emitting unit, and generates the driving power of the second power driver to be supplied to the second light emitting unit which emits light next.

4. The display apparatus according to claim 1, wherein the first and second power drivers compare respective output voltages that are proportional to respective currents supplied to the at least one of the plurality of light emitting units and the respective reference voltages, in order to output the respective driving power.

5. The display apparatus according to claim 4, wherein the power drivers comprise:

a pulse width modulation (PWM) generator for generating a PWM signal according to a comparison result, by comparing the output voltage and the reference voltage; and a PWM switch to switch on and off power supply according to the PWM signal.

6. The display apparatus according to claim 1, wherein the power switch comprises switching elements, which are respectively provided in the plurality of light emitting units and controlled by the controller to selectively supply the driving power output from the first and second power drivers, respectively, and to sequentially supply the driving power from the first and second power drivers to the first and second light emitting units.

7. The display apparatus according to claim 4, wherein, while the first power driver outputs driving power to be supplied to the first light emitting unit, the controller supplies the second reference voltage to the second power driver to generate driving power to be supplied to the second light emitting unit in next sequence.

8. A method of controlling a display apparatus having a plurality of light emitting units, the method comprising:

providing a number of power drivers less than the number of the plurality of light emitting units;

generating driving power of a first power driver and a second power driver, of the plurality of power drivers, to be supplied to at least one of the plurality of light emitting units;

controlling a switching element connected to the first power driver and the second power driver, respectively, to supply the driving power to at least one of the plurality of light emitting units; and supplying the driving power from the first and second power drivers sequentially to the at least one of the plurality of light emitting units;

wherein a first reference voltage and a second reference voltage are supplied to the first and second power drivers, respectively, the first power driver outputs driving power to be supplied to a first light emitting unit, the second power driver outputs driving power to be supplied to a second light emitting unit, and the plurality of light emitting units comprise the first and the second light emitting units.

9. The method according to claim 8, further comprising supplying the driving power outputted from the first power driver to the first light emitting unit, and generating the driving power of the second power driver to be supplied to the second light emitting unit which emits light next.

10. The method according to claim 8, further comprising controlling the first and second power drivers to sequentially output driving power corresponding to the respective first light emitting unit and the second light emitting unit; and wherein each light emitting unit comprises a plurality of light emitting elements.

11. The method according to claim 8, wherein the driving power is generated by comparing an output voltage that is proportional to current supplied to the at least one of the plurality of light emitting units and a reference voltage.

* * * * *